US009073070B2

(12) United States Patent
Funseth et al.

(10) Patent No.: US 9,073,070 B2
(45) Date of Patent: Jul. 7, 2015

(54) SPRAYER NOZZLE APPARATUS

(75) Inventors: Travis G. Funseth, Ankeny, IA (US); Richard A. Humpal, Ankeny, IA (US)

(73) Assignee: DEERE & COMPANY, Moline, IL (US)

( * ) Notice: Subject to any disclaimer, the term of this patent is extended or adjusted under 35 U.S.C. 154(b) by 500 days.

(21) Appl. No.: 13/457,598

(22) Filed: Apr. 27, 2012

(65) Prior Publication Data

US 2013/0284826 A1 Oct. 31, 2013

(51) Int. Cl.

| | |
|---|---|
| ***B05B 1/16*** | (2006.01) |
| ***B05B 1/20*** | (2006.01) |
| ***B05B 1/14*** | (2006.01) |
| ***B05B 15/06*** | (2006.01) |

(52) U.S. Cl.

CPC ..... *B05B 1/14* (2013.01); *B05B 1/1609* (2013.01); *B05B 1/1636* (2013.01); *B05B 1/1645* (2013.01); *B05B 1/169* (2013.01); *B05B 15/065* (2013.01)

(58) Field of Classification Search

CPC ..... B05B 1/14; B05B 1/16; B05B 1/1636; B05B 1/1645; B05B 1/1654; B05B 1/1672; B05B 1/169; B05B 1/20; B05B 1/202; B05B 15/065

USPC ..... 239/67, 159, 170, 442, 549–551, 562, 239/565, 566, 581.1

See application file for complete search history.

(56) References Cited

U.S. PATENT DOCUMENTS

| | | | | |
|---|---|---|---|---|
| 2,680,652 | A * | 6/1954 | Kooistra | 239/493 |
| 3,779,533 | A * | 12/1973 | Etter | 239/394 |
| 3,826,431 | A * | 7/1974 | Telge | 239/551 |
| 3,863,841 | A * | 2/1975 | Berthoud | 239/266 |
| 4,058,260 | A * | 11/1977 | Lestradet | 239/394 |
| 5,134,961 | A | 8/1992 | Giles et al. | |
| 5,253,807 | A * | 10/1993 | Newbegin | 239/11 |
| 6,126,088 | A * | 10/2000 | Wilger et al. | 239/170 |
| 7,124,964 | B2 | 10/2006 | Bui | |
| 7,578,454 | B2 * | 8/2009 | Joo | 239/488 |
| 7,861,946 | B2 | 1/2011 | Beeren | |
| 2002/0190140 | A1 * | 12/2002 | Arenson et al. | 239/391 |
| 2006/0108456 | A1 * | 5/2006 | Beeren | 239/600 |
| 2008/0087750 | A1 * | 4/2008 | Waddelow et al. | 239/550 |
| 2008/0245282 | A1 * | 10/2008 | Richards | 111/127 |
| 2009/0184182 | A1 * | 7/2009 | Beeren | 239/581.1 |

OTHER PUBLICATIONS

U.S. Appl. No. 13/333,178, Title: Arrangement for Switching Nozzles on the Go for Controlling Spray Rate, filed Dec. 21, 2011.

U.S. Appl. No. 13/333,541, Title: Sprayer Pulsing Nozzle Flow Control Using Rotational Step Positions, filed Jan. 3, 2012.

* cited by examiner

*Primary Examiner* — Darren W Gorman

(57) ABSTRACT

A sprayer nozzle apparatus of an agricultural sprayer is disclosed. The sprayer nozzle apparatus is adapted for receiving a fluid from a spray line of an agricultural sprayer. The sprayer nozzle apparatus includes an apparatus housing. A control element is rotatably coupled to the apparatus housing. A plurality of nozzle connectors having a plurality of supply paths are coupled to the apparatus housing. The control element is configured to receive fluid from the spray line and selectively communicate fluid to at least one of the plurality of supply paths of one of the plurality of nozzle connectors in a first position and to at least one of the plurality of supply paths of another of the plurality of nozzle connectors in a second position.

20 Claims, 16 Drawing Sheets

50
85
75
70
60
100
90
10
55
15
65
80
95
35
40
45
30
20
25
25
25
35"
40"
45"
30"
65"
80"
95"
55"
60"
90"
70"
100"
75"
85"
50"

385
370
400
375
360
390
350
355
365
380
395
310
335
340
345
321
323
323
323
323
323
320
335'
340'
345'
315
330'
365'
380'
395'
355'
350'
360'
375'
390'
370'
385'
400'

SPRAYER NOZZLE APPARATUS

FIELD OF THE DISCLOSURE

The present disclosure generally relates to agricultural sprayers, and more particularly to a sprayer nozzle apparatus of agricultural sprayers.

BACKGROUND OF THE DISCLOSURE

In order to spray a fluid (e.g., fertilizer, pesticide, fungicide, insecticide) onto agricultural crops, agricultural sprayers commonly include a sprayer nozzle apparatus. The sprayer nozzle apparatus commonly includes a nozzle connector for supporting a nozzle having an orifice. The geometry of the orifice influences the flow rate, droplet size, and spray pattern. The flow rate through the orifice is mainly a function of the orifice geometry and the fluid pressure at the orifice (i.e., pressure just prior to the orifice). Since the orifice geometry is typically fixed, the most common way to influence the flow rate through the nozzle is by changing fluid pressure. Changing the fluid pressure at the nozzle to influence flow rate changes has become common place on sprayers in order to allow for variable vehicle speed. The flow rate is changed in proportion to the vehicle speed in order to keep the application rate the same.

However, using the traditional fixed orifice nozzle has some limitations. The pressure versus flow relationship is a squared function. To double the flow requires increasing the pressure by a factor of four times. Unfortunately, changing pressure also changes atomization dynamics resulting in an impact on spray quality. Spray quality characteristics, namely, droplet size and spray angle, both become smaller as pressure increases. These changes can negatively impact spray deposit and spray drift. So, the need for the ability to change nozzles on the go has emerged.

SUMMARY OF THE DISCLOSURE

In one embodiment, a sprayer nozzle apparatus is disclosed. The sprayer nozzle apparatus is adapted for receiving a fluid from a spray line of an agricultural sprayer. The sprayer nozzle apparatus includes an apparatus housing. A control element is rotatably coupled to the apparatus housing. A first nozzle connector having a first supply path and a second supply path is coupled to the apparatus housing. A second nozzle connector having a third supply path and a fourth supply path is coupled to the apparatus housing. The control element is configured to receive fluid from the spray line and selectively communicate fluid to at least one of the first supply path and the second supply path in a first position and to at least one of the third supply path and the fourth supply path in a second position.

In another embodiment, a sprayer nozzle apparatus is disclosed. The sprayer nozzle apparatus is adapted for receiving a fluid from a spray line of an agricultural sprayer. The sprayer nozzle apparatus includes an apparatus housing. A control element is rotatably coupled to the apparatus housing. A plurality of nozzle connectors having a plurality of supply paths are coupled to the apparatus housing. The control element is configured to receive fluid from the spray line and selectively communicate fluid to at least one of the plurality of supply paths of one of the plurality of nozzle connectors in a first position and to at least one of the plurality of supply paths of another of the plurality of nozzle connectors in a second position.

In yet another embodiment, a sprayer nozzle apparatus is disclosed. The sprayer nozzle apparatus is adapted for receiving a fluid from a spray line of an agricultural sprayer. The sprayer nozzle apparatus includes an apparatus housing. A control element is rotatably coupled to the apparatus housing. A first nozzle connector having a first supply path and a second supply path is coupled to the apparatus housing. A second nozzle connector having a third supply path and a fourth supply path is coupled to the apparatus housing.

A first sprayer nozzle cartridge is coupled to the first nozzle connector. The first sprayer nozzle cartridge has a first cartridge housing and a first nozzle tip with a first flow path in fluid communication with the first supply path. The first nozzle tip is coupled to the first cartridge housing. The first sprayer nozzle cartridge has a second nozzle tip with a second flow path in fluid communication with the second supply path. The second nozzle tip is coupled to the first cartridge housing.

A second sprayer nozzle cartridge is coupled to the second nozzle connector. The second sprayer nozzle cartridge has a second cartridge housing and a third nozzle tip with a third flow path in fluid communication with the third supply path. The third nozzle tip is coupled to the second cartridge housing. The second sprayer nozzle cartridge has a fourth nozzle tip with a fourth flow path in fluid communication with the fourth supply path. The fourth nozzle tip is coupled to the second cartridge housing. The control element is configured to receive fluid from the spray line and selectively communicate fluid to at least one of the first supply path and the second supply path in a first position and to at least one of the third supply path and the fourth supply path in a second position.

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

DETAILED DESCRIPTION

Figure 1:
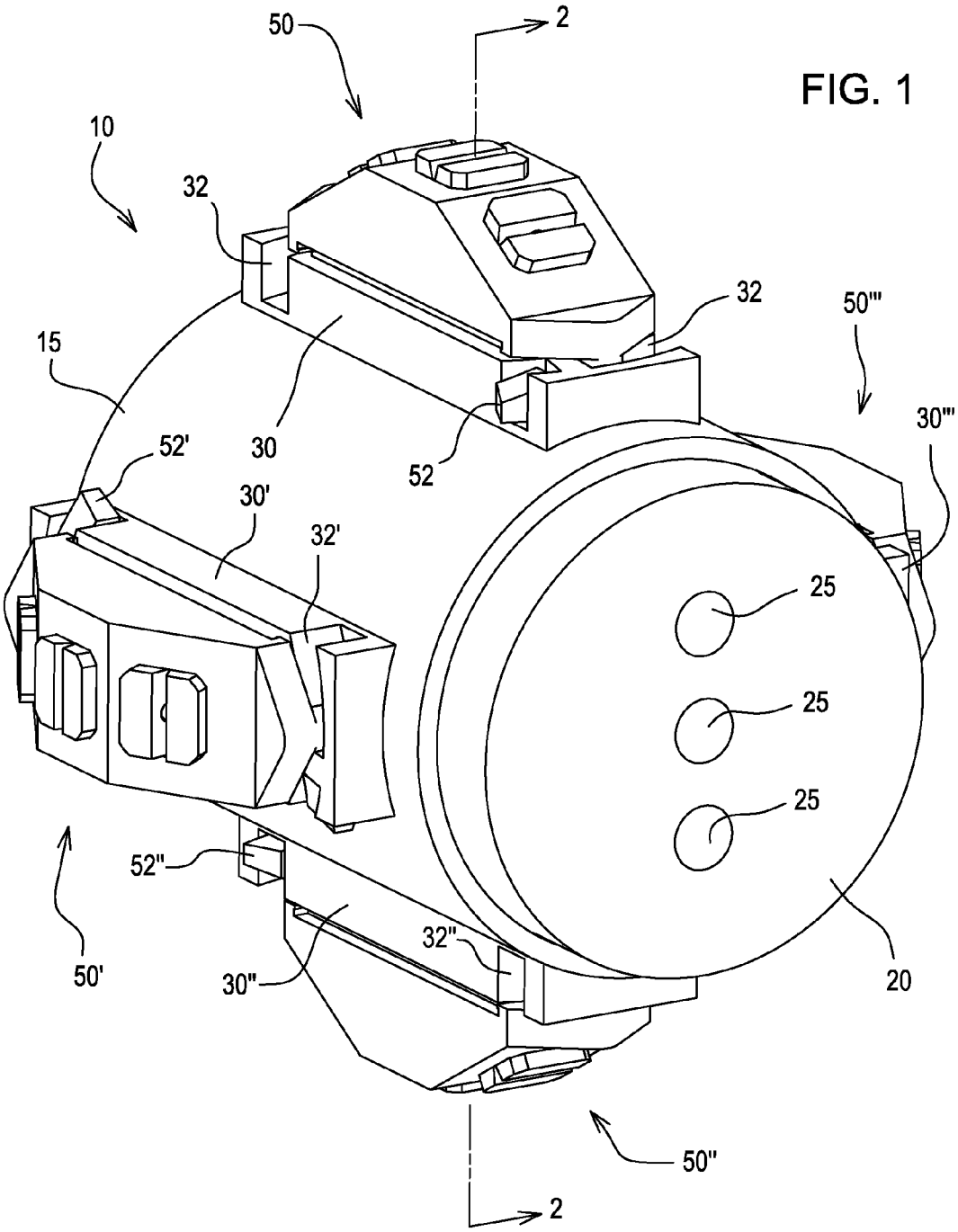
FIG. 1 is a perspective view of a sprayer nozzle apparatus including a plurality of sprayer nozzle cartridges according to one embodiment.

FIG. 1 illustrates a sprayer nozzle apparatus 10 of an agricultural sprayer (not shown) according to one embodiment. The illustrated sprayer nozzle apparatus 10 includes an adjustable apparatus housing 15.

A control element 20 is rotatably coupled to the adjustable apparatus housing 15 enabling the adjustable apparatus housing 15 to rotate relative to the control element 20. Exemplarily, the control element 20 has three fluid inlets 25. The three fluid inlets 25 are in fluid communication with a spray line containing a valve or valves (not shown) of an agricultural sprayer. Other types of control elements 20 are contemplated by this disclosure (e.g., ball valve).

Figure 2:
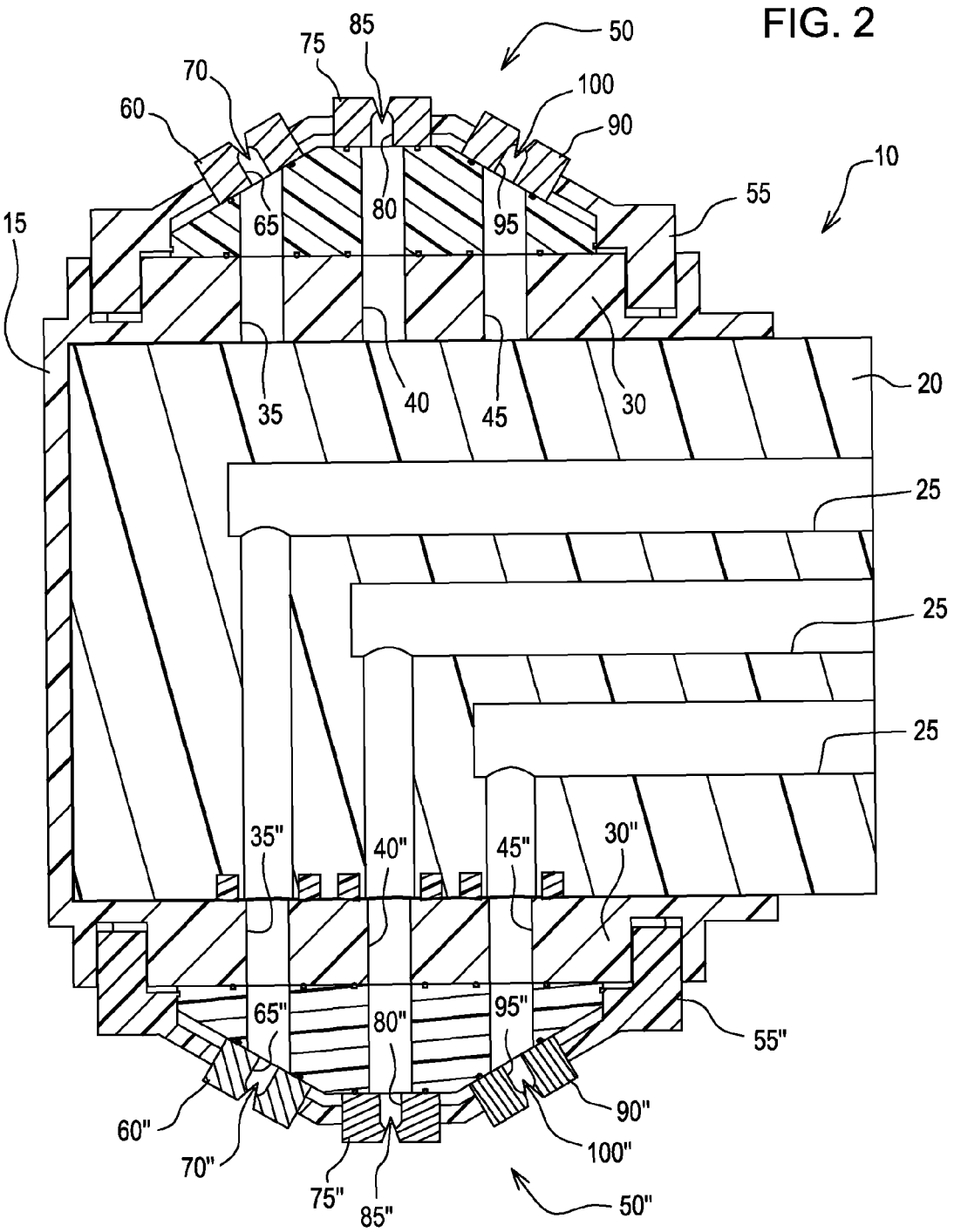
FIG. 2 is a sectional view taken along lines 2-2 of FIG. 1.

Exemplarily, four nozzle connectors 30, 30', 30", 30'" are coupled to the adjustable apparatus housing 15. With reference to FIG. 2, the nozzle connectors 30, 30', 30", 30'" have a first supply path 35, 35', 35", 35'", a second supply path 40, 40', 40", 40'", and a third supply path 45, 45', 45", 45'", respectively. Referring to FIG. 1, the nozzle connectors 30, 30', 30", 30'" have opposed slots 32, 32', 32", 32'" for receiving a sprayer nozzle cartridge 50, 50', 50", 50'", respectively.

The sprayer nozzle cartridges 50, 50', 50", 50'" include protrusions 52, 52', 52", 52'" for releaseably engaging the slots 32, 32', 32", 32'". With further reference to FIG. 2, the sprayer nozzle cartridges 50, 50', 50", 50'" include a cartridge housing 55, 55', 55", 55'", respectively. A first nozzle tip 60, 60', 60", 60'" having a first flow path 65, 65', 65", 65'" and a first orifice 70, 70', 70", 70'" is coupled to the cartridge housing 55, 55', 55", 55'". The first flow path 65, 65', 65", 65'" is in fluid communication with the first supply path 35, 35', 35", 35'". A second nozzle tip 75, 75', 75", 75'" having a second flow path 80, 80', 80", 80'" and a second orifice 85, 85', 85", 85'" is coupled to the cartridge housing 55, 55', 55", 55'". The second flow path 80, 80', 80", 80'" is in fluid communication with the second supply path 40, 40', 40", 40'". A third nozzle tip 90, 90', 90", 90'" having a third flow path 95, 95', 95", 95'" and a third orifice 100, 100', 100", 100'" is coupled to the cartridge housing 55, 55', 55", 55'". The third flow path 95, 95', 95", 95'" is in fluid communication with the third supply path 45, 45', 45", 45'".

In operation, the control element 20 receives fluid from the spray line and, in a first position, selectively communicates fluid to the first supply path 35, the second supply path 40, and the third supply path 45, thereby communicating fluid to the first flow path 65, the second flow path 80, and the third flow path 95, respectively. The control element 20 may selectively communicate fluid to more than one supply path 35, 40, 45 or to none of the supply paths 35, 40, 45 depending on the orientation of the valve, or valves, in the spray line. It is contemplated by this disclosure that the control element 20 may change supply paths 35, 40, 45 while the agricultural sprayer is stationary or moving. It is also contemplated that the nozzle tips 60, 75, 90 may have orifices 70, 85, 100 with varying geometries in order to allow for varying vehicle speed and/or desired spray qualities. It is further contemplated that the adjustable apparatus housing 15 may rotate while the agricultural sprayer is stationary or moving.

The adjustable apparatus housing 15 rotates manually, remotely, or automatically to a second position where the control element 20 selectively communicates fluid to the supply paths 35', 40', 45', thereby communicating fluid to the flow paths 65', 80', 95'. The control element 20 may selectively communicate fluid to more than one supply path 35', 40', 45' or to none of the supply paths 35', 40', 45' depending on the orientation of the valve, or valves, in the spray line. It is contemplated by this disclosure that the control element 20 may change supply paths 35', 40', 45' while the agricultural sprayer is stationary or moving. It is also contemplated that the nozzle tips 60', 75', 90' may have orifices 70', 85', 100' with varying geometries in order to allow for varying vehicle speed and/or desired spray qualities.

The adjustable apparatus housing 15 rotates manually, remotely, or automatically to a third position where the control element 20 selectively communicates fluid to the supply paths 35", 40", 45", thereby communicating fluid to the flow paths 65", 80", 95". The control element 20 may selectively communicate fluid to more than one supply path 35", 40", 45" or to none of the supply paths 35", 40", 45" depending on the orientation of the valve, or valves, in the spray line. It is contemplated by this disclosure that the control element 20 may change supply paths 35", 40", 45" while the agricultural sprayer is stationary or moving. It is also contemplated that the nozzle tips 60", 75", 90" may have orifices 70", 85", 100" with varying geometries in order to allow for varying vehicle speed and/or desired spray qualities.

The adjustable apparatus housing 15 rotates manually, remotely, or automatically to a fourth position where the control element 20 selectively communicates fluid to the supply paths 35'", 40'", 45'", thereby communicating fluid to the flow paths 65'", 80'", 95'". The control element 20 may selectively communicate fluid to more than one supply path 35'", 40'", 45'" or to none of the supply paths 35'", 40'", 45'" depending on the orientation of the valve, or valves, in the spray line. It is contemplated by this disclosure that the control element 20 may change supply paths 35'", 40'", 45'" while the agricultural sprayer is stationary or moving. It is also contemplated that the nozzle tips 60'", 75'", 90'" may have orifices 70'", 85'", 100'" with varying geometries in order to allow for varying vehicle speed and/or desired spray qualities.

FIGS. 3-6 illustrate a sprayer nozzle apparatus 110 of an agricultural sprayer (not shown) according to another embodiment. The sprayer nozzle apparatus 110 includes features similar to the sprayer nozzle apparatus 10 of FIGS. 1 and 2, and therefore, like components have been given like reference numerals plus 100 and only the differences between the sprayer nozzle apparatuses 10 and 110 will be discussed in detail below.

Figure 3:
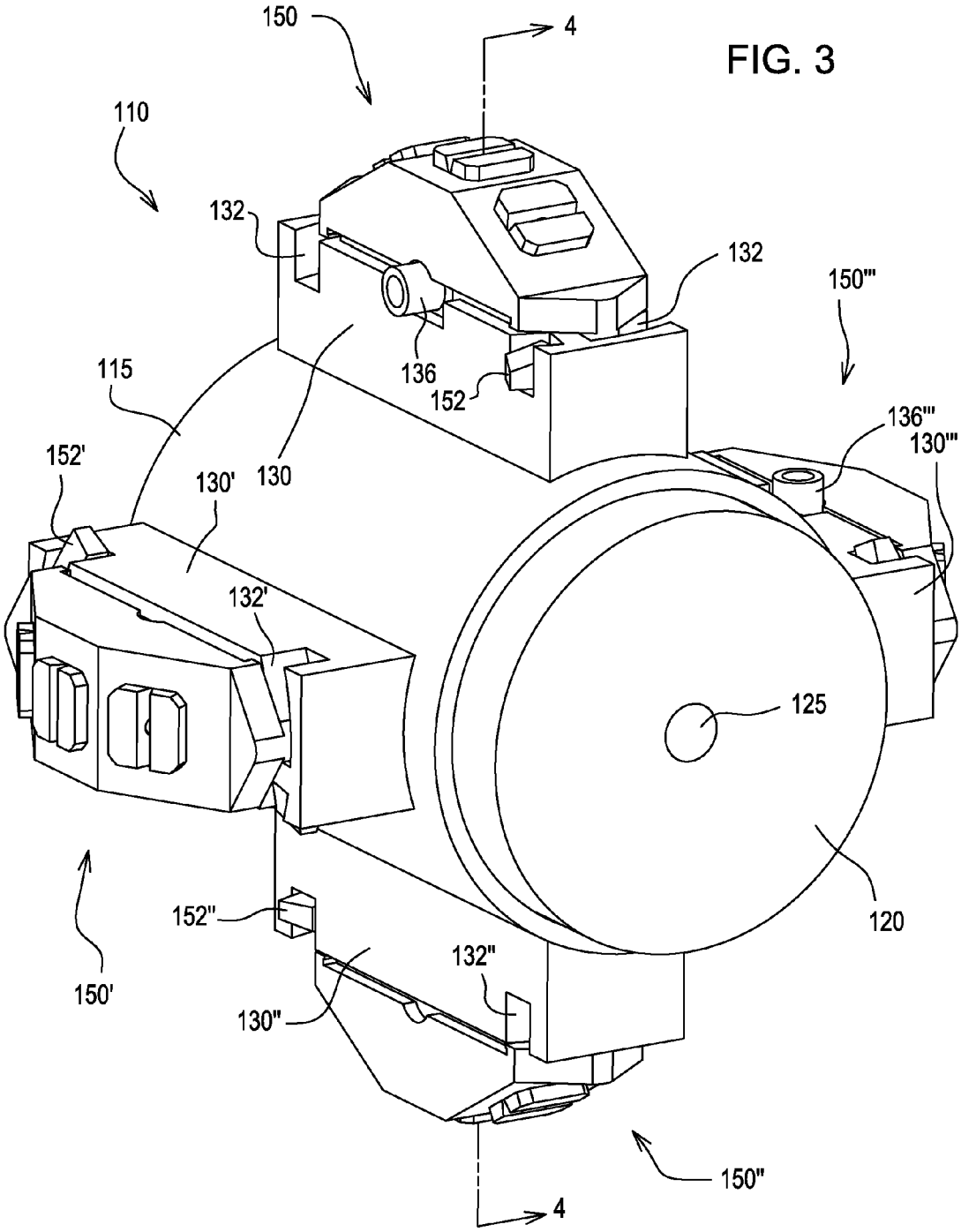
FIG. 3 is a perspective view of a sprayer nozzle apparatus including a plurality of sprayer nozzle cartridges according to another embodiment.
Figure 4:
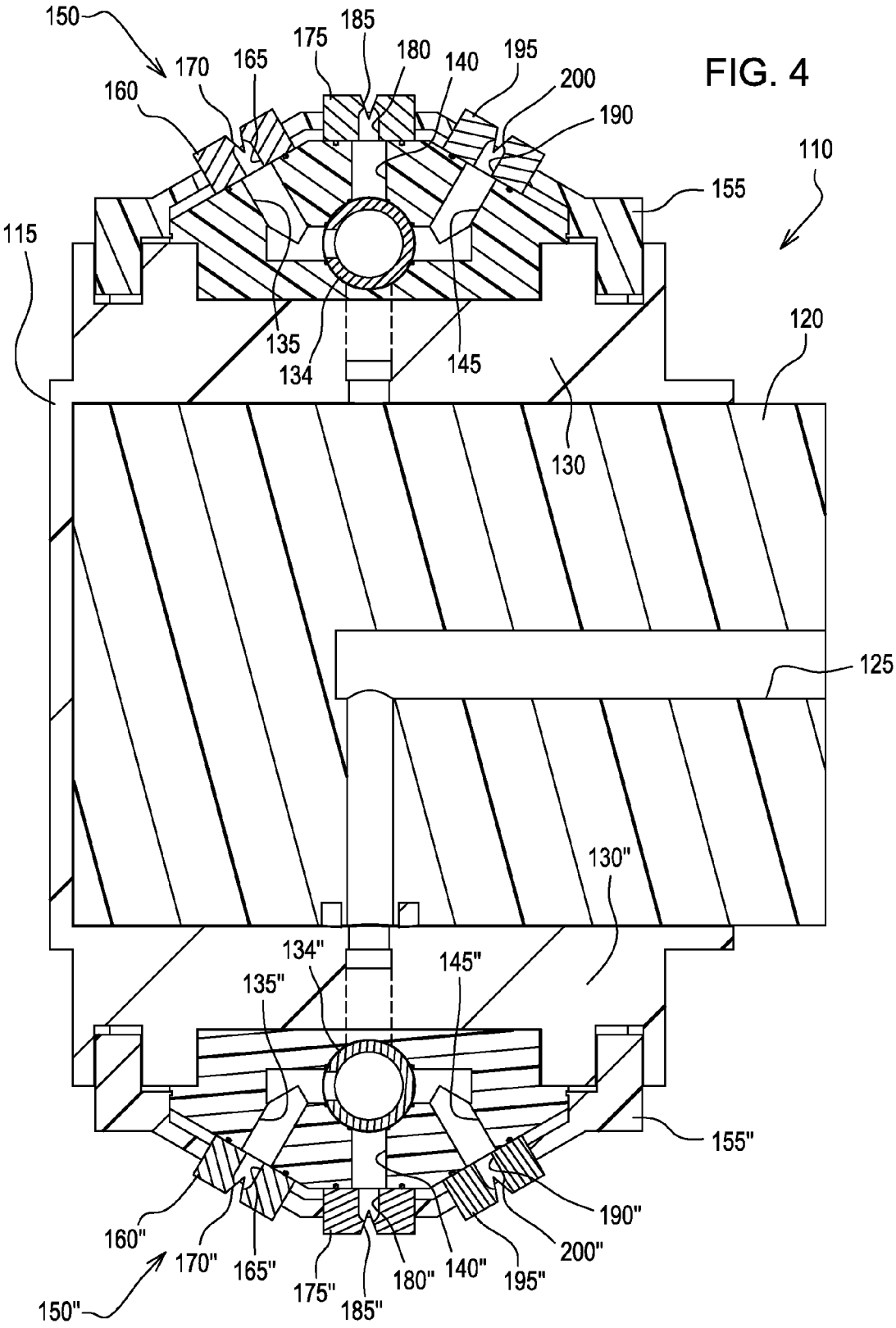
FIG. 4 is a sectional view taken along lines 4-4 of FIG. 3.
Figure 5:
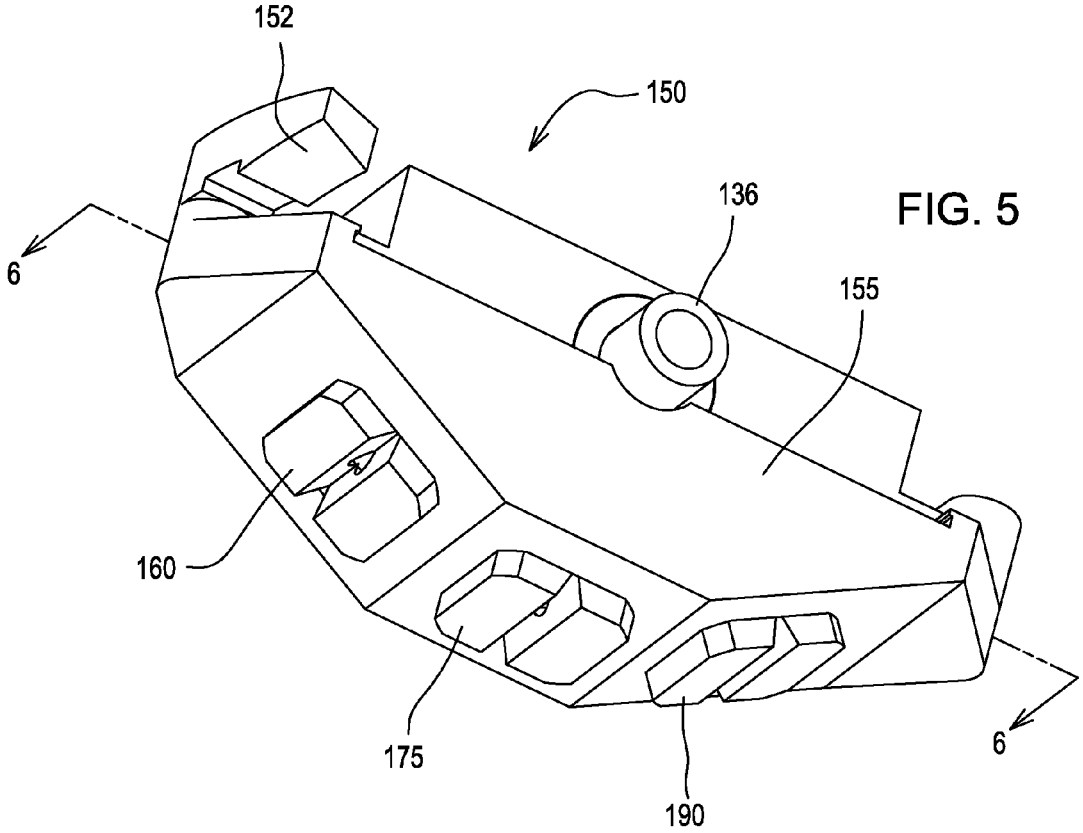
FIG. 5 is an enlarged perspective view of the sprayer nozzle cartridge of FIG. 3.
Figure 6:
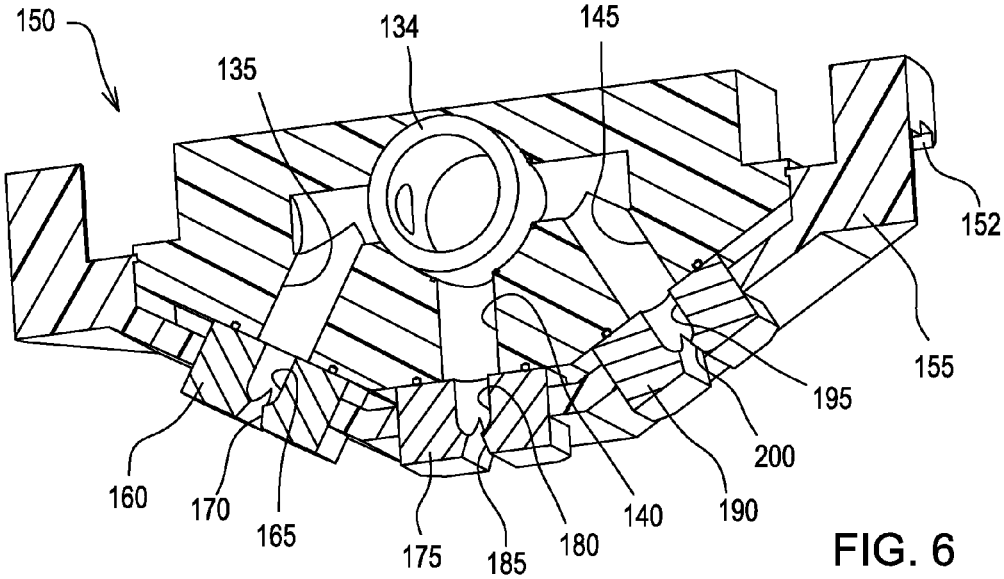
FIG. 6 is an enlarged sectional view taken along lines 6-6 of FIG. 5.

With reference to FIGS. 3 and 4, exemplarily, a control element 120 has one fluid inlet 125. The fluid inlet 125 is in fluid communication with a spray line (not shown) of an agricultural sprayer. The spray line may have a valve (not shown).

Referring to FIG. 4, sprayer nozzle cartridges 150, 150', 150", 150'" include a ball valve 134, 134', 134", 134'", respectively, having an adjustment portion 136, 136', 136", 136'", that receives fluid from the fluid inlet 125. The sprayer nozzle cartridges 150, 150', 150", 150'" include a first supply path 135, 135', 135", 135'", a second supply path 140, 140', 140", 140'", and a third supply path 145, 145', 145", 145'". Alternatively, the ball valves 134, 134', 134", 134'" may be other types of valves (e.g., cylindrical-shaped control valve, poppet, piezo control element).

In operation, in a first position, the adjustment portion 136 is oriented by a positioning device (not shown) so the ball valve 134 selectively communicates fluid to at least one of the first supply path 135, the second supply path 140, and the third supply path 145, thereby communicating fluid to at least one of a first flow path 165, a second flow path 180, and a third flow path 195, respectively.

In a second position, the adjustment portion 136' is oriented by a positioning device (not shown) so the ball valve 134' selectively communicates fluid to at least one of the supply paths 135', 140', 145', thereby communicating fluid to at least one of a first flow path 165', a second flow path 180', and a third flow path 195', respectively.

In a third position, the adjustment portion 136" is oriented by a positioning device (not shown) so the ball valve 134" selectively communicates fluid to at least one of the supply paths 135", 140", 145", thereby communicating fluid to at least one of a first flow path 165", a second flow path 180", and a third flow path 195", respectively.

In a fourth position, the adjustment portion 136'" is oriented by a positioning device (not shown) so the ball valve 134'" selectively communicates fluid to at least one of the supply paths 135'", 140'", 145'", thereby communicating fluid to at least one of a first flow path 165'", a second flow path 180'", and a third flow path 195'", respectively.

Figure 7:
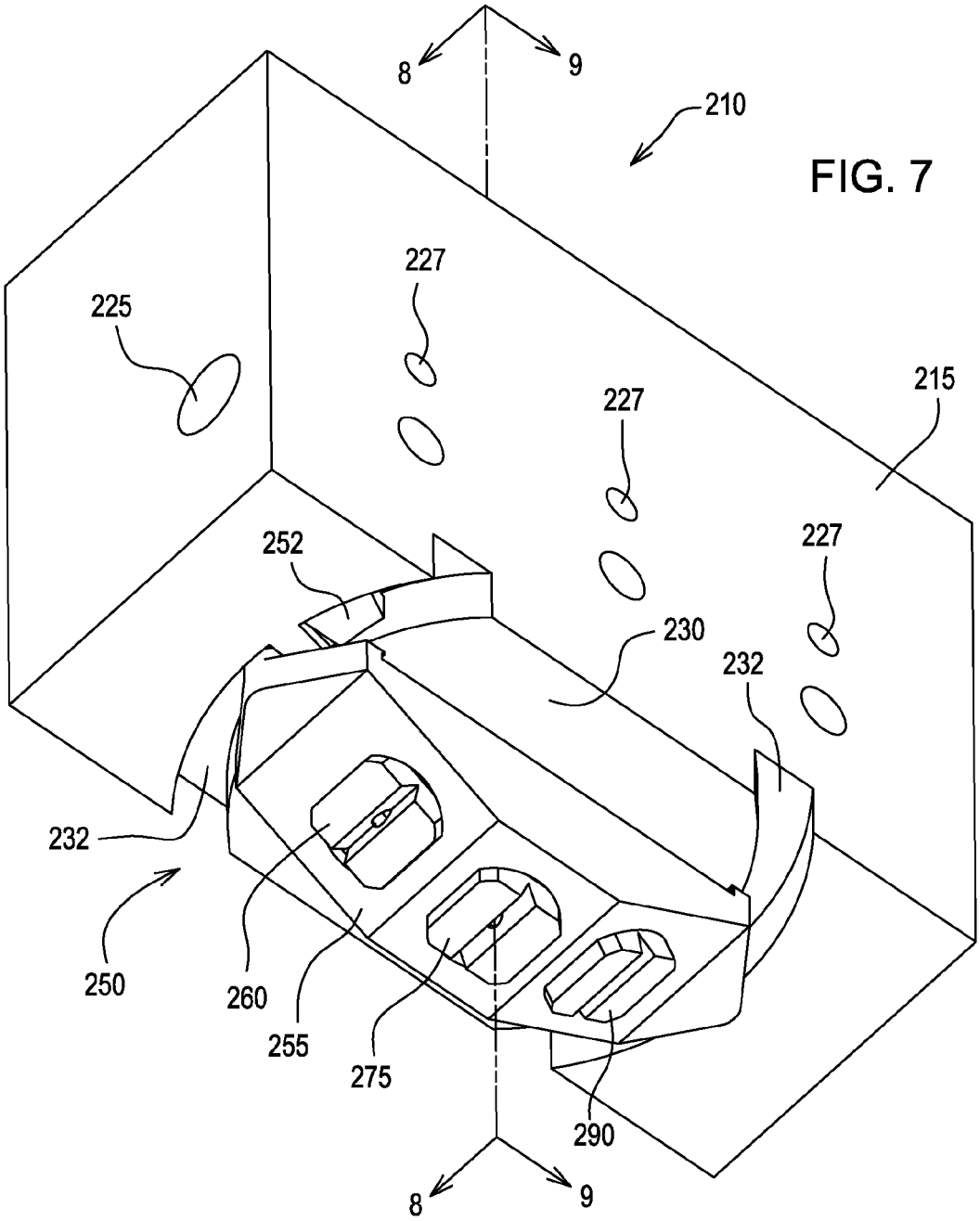
FIG. 7 is a perspective view of a sprayer nozzle apparatus including a sprayer nozzle cartridge according to yet another embodiment.
Figure 8:
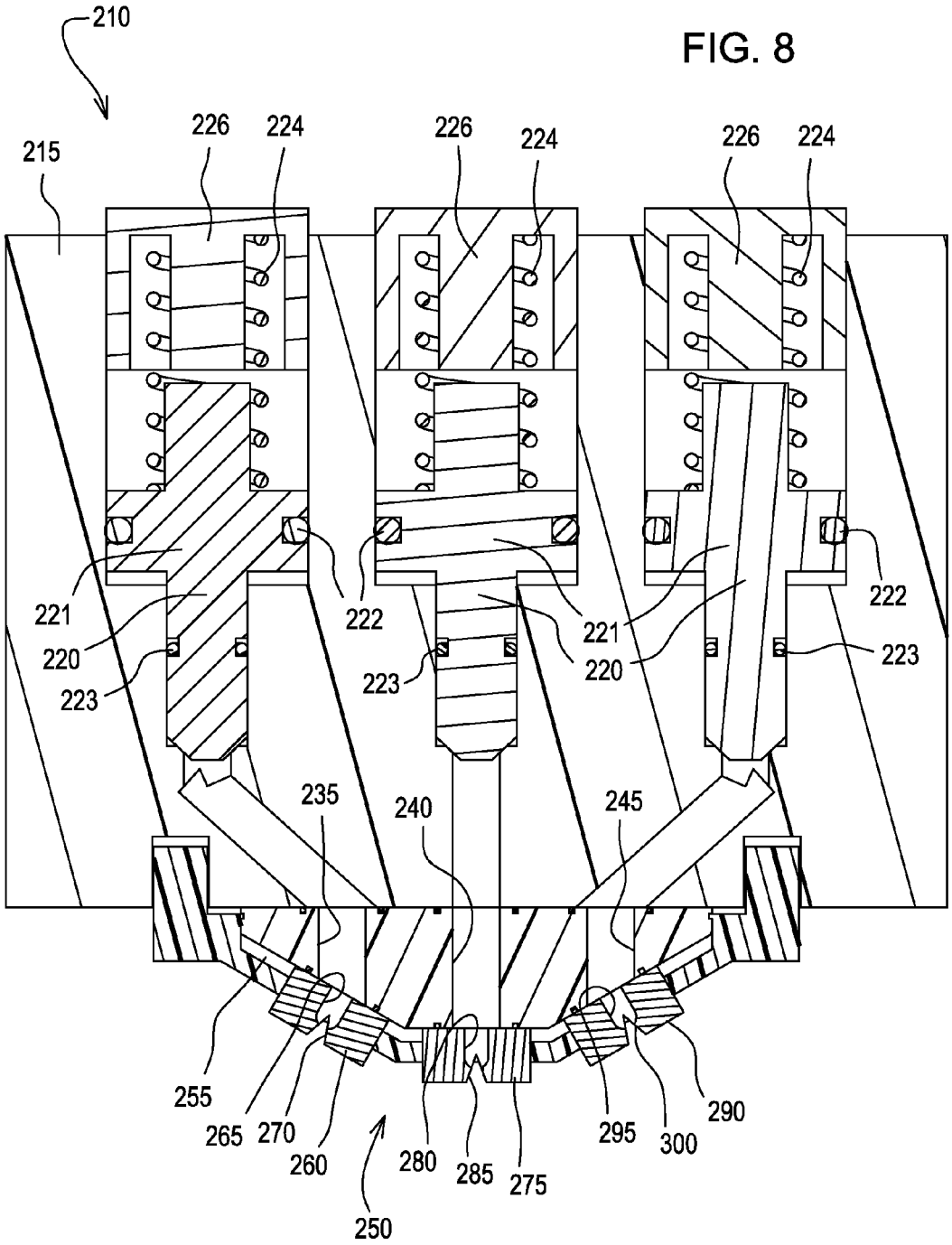
FIG. 8 is an enlarged sectional view taken along lines 8-8 of FIG. 7.
Figure 9:
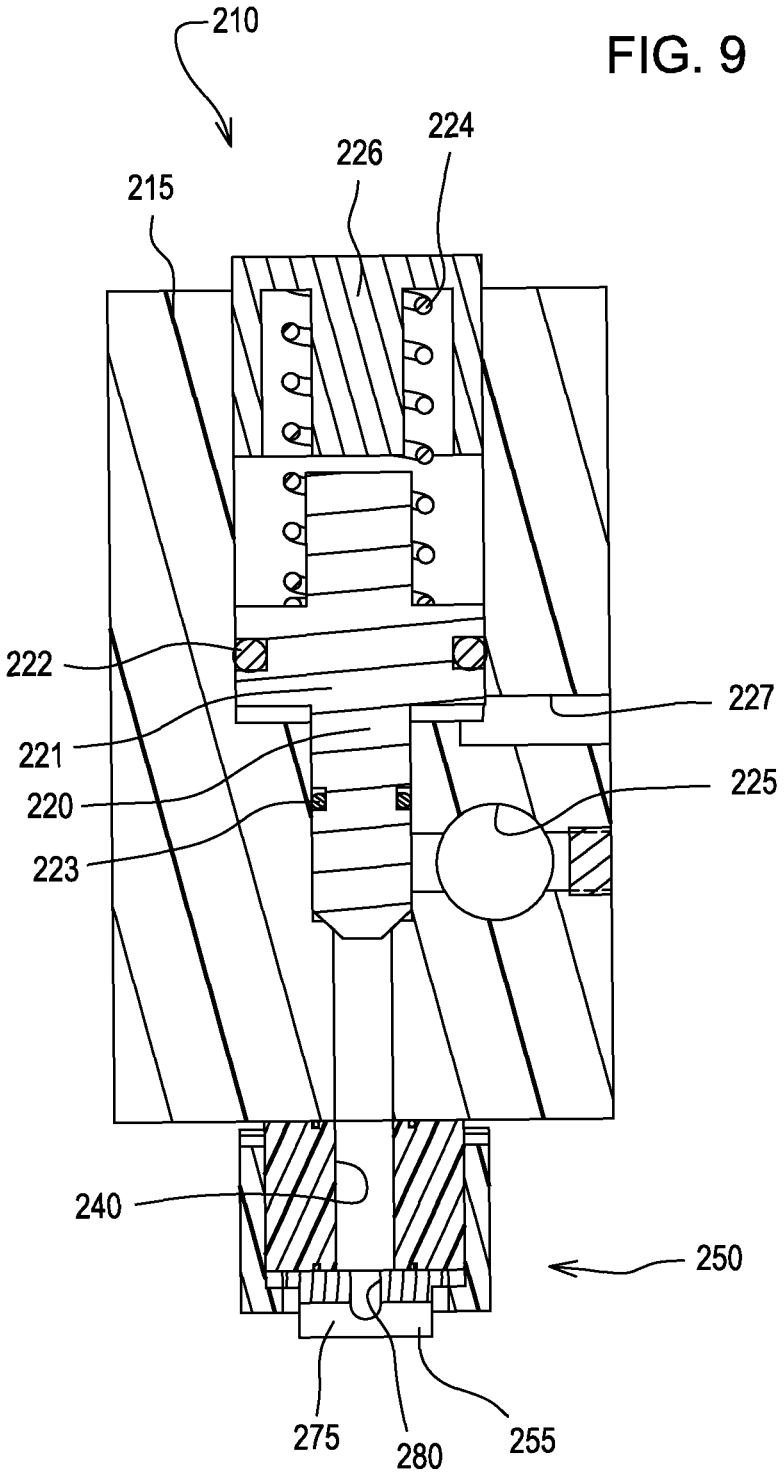
FIG. 9 is an enlarged sectional view taken along lines 9-9 of FIG. 7.

FIGS. 7-9 illustrate a sprayer nozzle apparatus 210 of an agricultural sprayer (not shown) according to another embodiment. The sprayer nozzle apparatus 210 includes features similar to the sprayer nozzle apparatus 10 of FIGS. 1 and 2, and therefore, like components have been given like reference numerals plus 200 and only the differences between the sprayer nozzle apparatuses 10 and 210 will be discussed in detail below.

Referring to FIG. 7, the sprayer nozzle apparatus 210 includes an apparatus housing 215 having a fluid inlet 225 and an air inlet 227. With reference to FIGS. 8 and 9, the sprayer nozzle apparatus 210 includes an adjustable control element 220 configured to control fluid flow. Exemplarily, the adjustable control element 220 has three air-actuated poppets 221 each with a first o-ring 222 and a second o-ring 223. A spring 224 biases the poppet 221 to prevent fluid flow. A cap 226 is threadably engaged with the apparatus housing 215 to secure the spring 224 within the apparatus housing 215.

With further reference to FIG. 7, a nozzle connector 230 having opposed slots 232 for receiving a sprayer nozzle cartridge 250 is coupled to the apparatus housing 215. The sprayer nozzle cartridge 250 includes protrusions 252 for releaseably engaging the slots 232.

In operation, air is selectively passed through the air inlet 227 in order to activate one or more of the poppets 221 by counteracting the biasing force of the spring 224. Fluid is passed through the fluid inlet 225 and the adjustable control element 220 selectively communicates fluid to at least one of the first flow path 265, the second flow path 280, and the third flow path 295. The adjustable control element 220 may selectively communicate fluid to more than one flow path 265, 280, 295 or to none of the flow paths 265, 280, 295.

Figure 10:
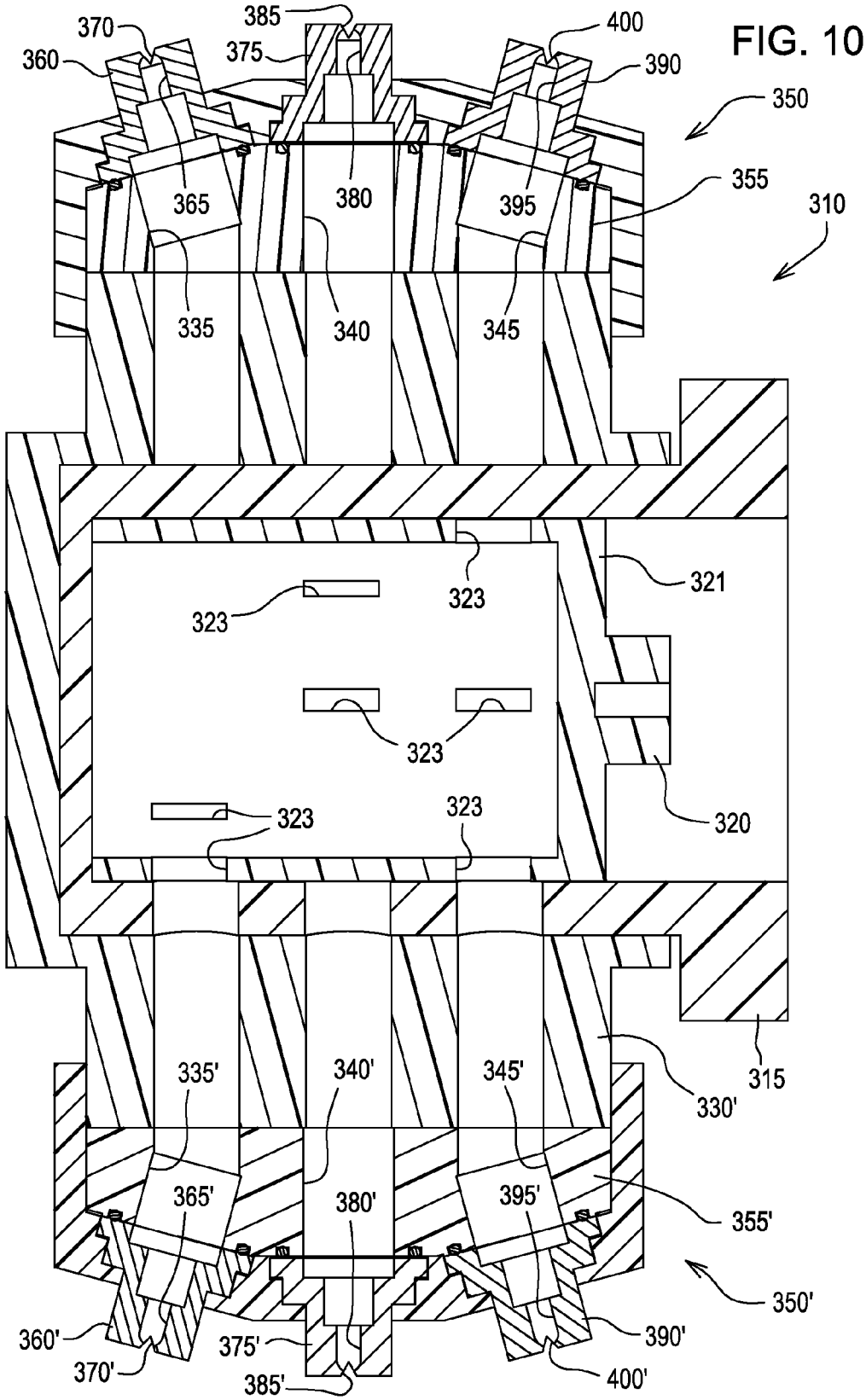
FIG. 10 is a sectional view of a sprayer nozzle apparatus including a sprayer nozzle cartridge according to another embodiment.

FIG. 10 illustrates a sprayer nozzle apparatus 310 of an agricultural sprayer (not shown) according to another embodiment. The sprayer nozzle apparatus 310 includes features similar to the sprayer nozzle apparatus 10 of FIGS. 1 and 2, and therefore, like components have been given like reference numerals plus 300 and only the differences between the sprayer nozzle apparatuses 10 and 310 will be discussed in detail below.

The sprayer nozzle apparatus 310 includes a control element 320 configured to control fluid flow. Exemplarily, the control element 320 has a rotor 321 with a plurality of slots 323.

In operation, the slots 323 of the control element 320 selectively communicate fluid to none or at least one of a first flow path 365, 365', a second flow path 380, 380', and a third flow path 395, 395'. In a first position, the slots 323 of the control element 320 may selectively communicate fluid to more than one flow path 365, 380, 395 or to none of the flow paths 365, 380, 395. In another position, the slots 323 of the control element 320 may selectively communicate fluid to more than one flow path 365', 380', 395' or to none of the flow paths 365', 380', 395'.

Figure 11:
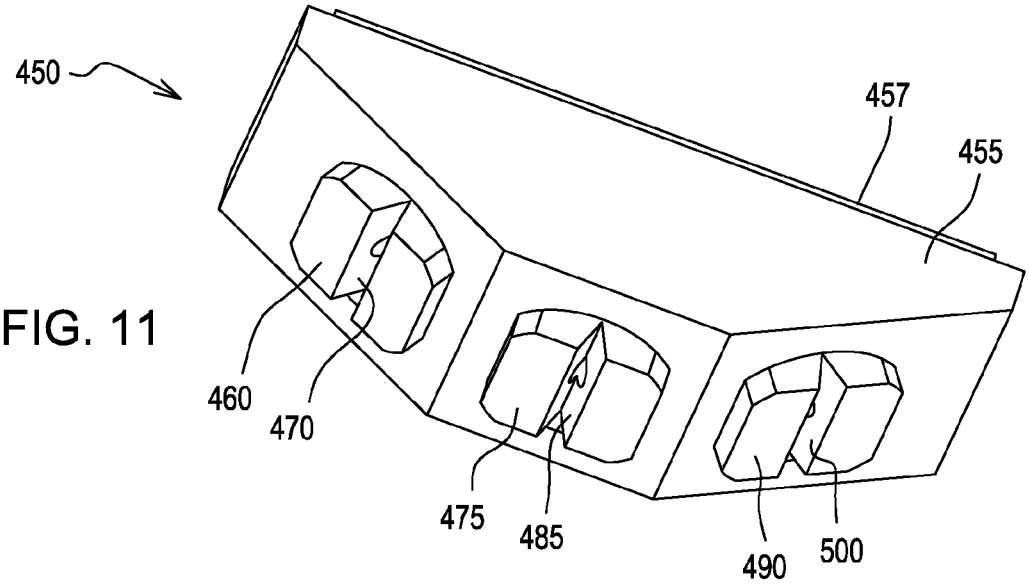
FIG. 11 is a perspective view of a sprayer nozzle cartridge according to yet another embodiment.
Figure 12:
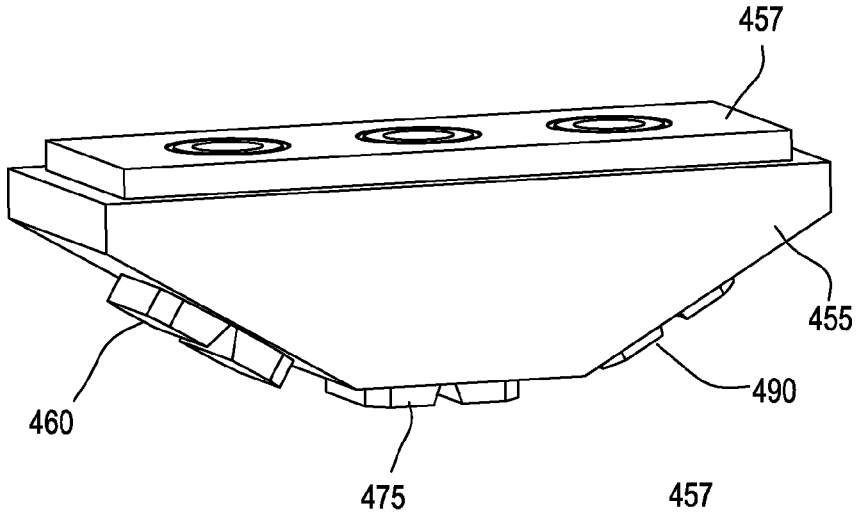
FIG. 12 is a perspective view of the sprayer nozzle cartridge of FIG. 11.
Figure 13:
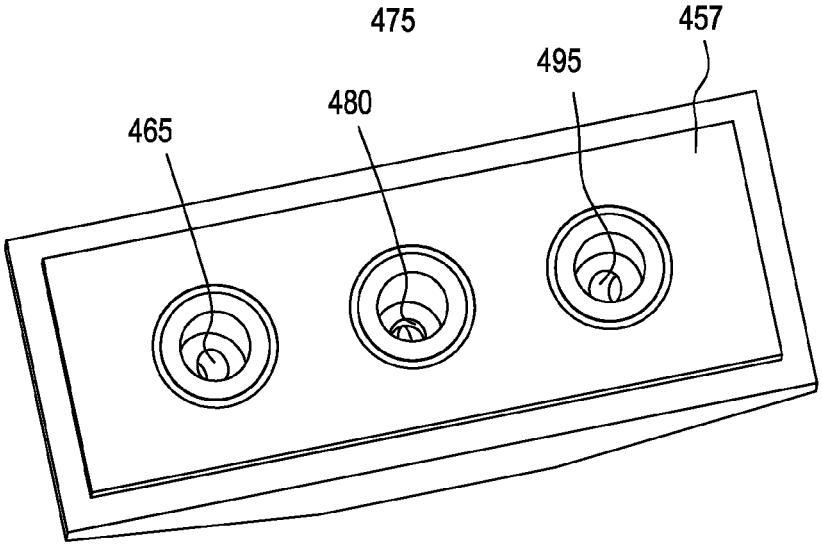
FIG. 13 is a bottom view of the sprayer nozzle cartridge of FIG. 11.

FIGS. 11-13 illustrate a sprayer nozzle cartridge 450 of an agricultural sprayer (not shown) according to another embodiment. The sprayer nozzle cartridge 450 includes features similar to the sprayer nozzle cartridge 50 of FIGS. 1 and 2, and therefore, like components have been given like reference numerals plus 400 and only the differences between the sprayer nozzle cartridges 50 and 450 will be discussed in detail below.

The sprayer nozzle cartridge 450 includes a cartridge housing 455 having a housing extension 457 that couples to a sprayer nozzle apparatus (not shown).

Figure 14:
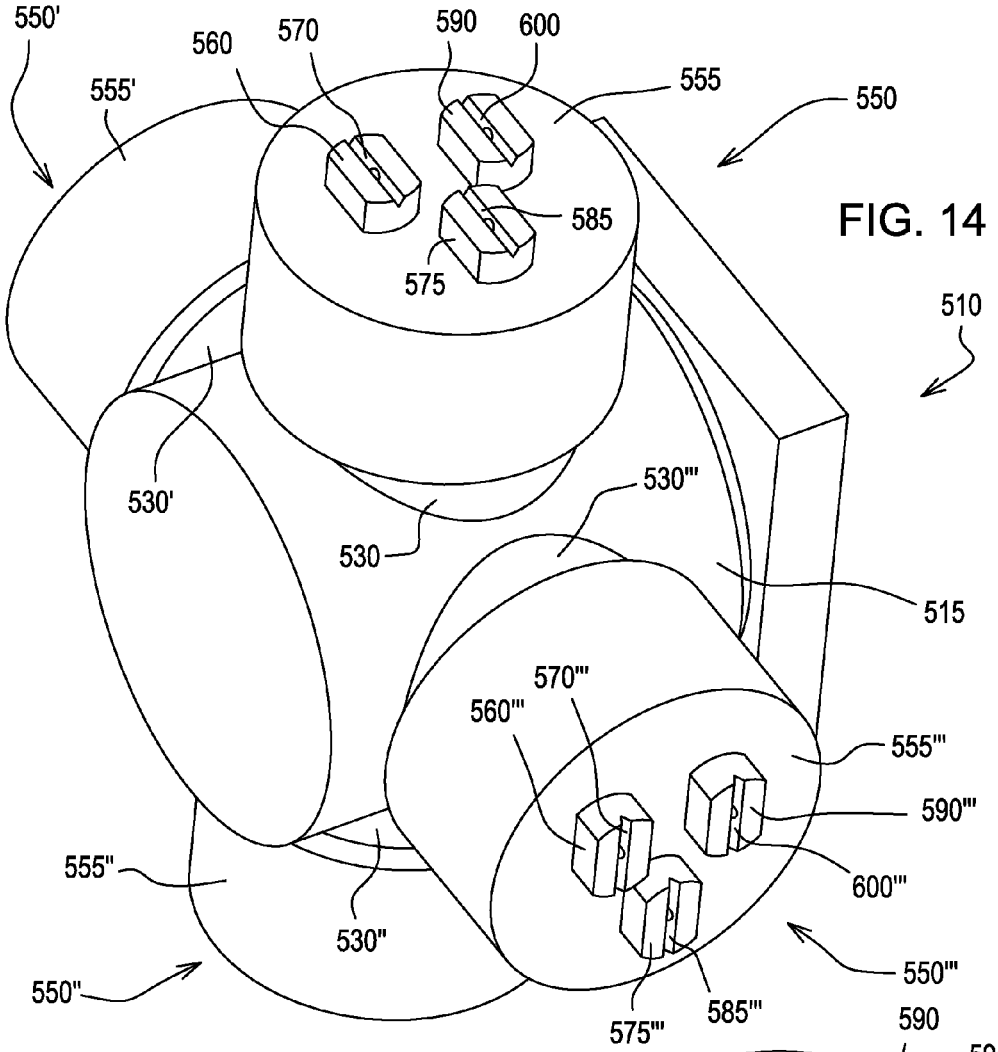
FIG. 14 is a perspective view of a sprayer nozzle apparatus including a plurality of sprayer nozzle cartridges according to another embodiment.
Figure 15:
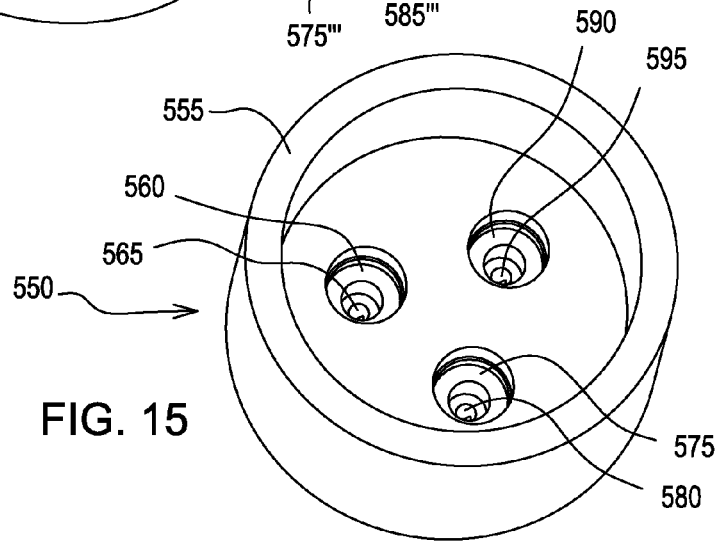
FIG. 15 is an enlarged bottom view of the sprayer nozzle cartridge of FIG. 14.

FIGS. 14 and 15 illustrate a sprayer nozzle apparatus 510 of an agricultural sprayer (not shown) according to another embodiment. The sprayer nozzle apparatus 510 includes features similar to the sprayer nozzle apparatus 10 of FIGS. 1 and 2, and therefore, like components have been given like reference numerals plus 500 and only the differences between the sprayer nozzle apparatuses 10 and 510 will be discussed in detail below.

The sprayer nozzle apparatus 510 includes an adjustable apparatus housing 515 for supporting four nozzle connectors 530, 530', 530", 530'". More or less nozzle connectors 530, 530', 530", 530'" may be used. The nozzle connectors 530, 530', 530", 530'" support a plurality of sprayer nozzle cartridges 550, 550', 550", 550'", respectively. Exemplarily, the sprayer nozzle cartridges 550, 550', 550", 550'" include a cylindrically-shaped cartridge housing 555, 555', 555", 555'", respectively. A first nozzle tip 560, 560', 560", 560'", a second nozzle tip 575, 575', 575", 575'", and a third nozzle tip 590, 590', 590", 590'" are coupled to the cylindrically-shaped cartridge housing 555, 555', 555", 555'" in a non-linear pattern. This disclosure contemplates that more or less nozzle tips (560, 575, 590), (560', 575', 590'), (560", 575", 590"), (560'", 575'", 590'") may be coupled to the cylindrically-shaped cartridge housing 555, 555', 555", 555'" in any pattern (e.g., linear, circular, square). This disclosure also contemplates that the nozzle connectors 530, 530', 530", 530'" and the cylindrically-shaped cartridge housings 555, 555', 555", 555'" may be any shape (e.g., square, rectangular, oblong).

Figure 16:
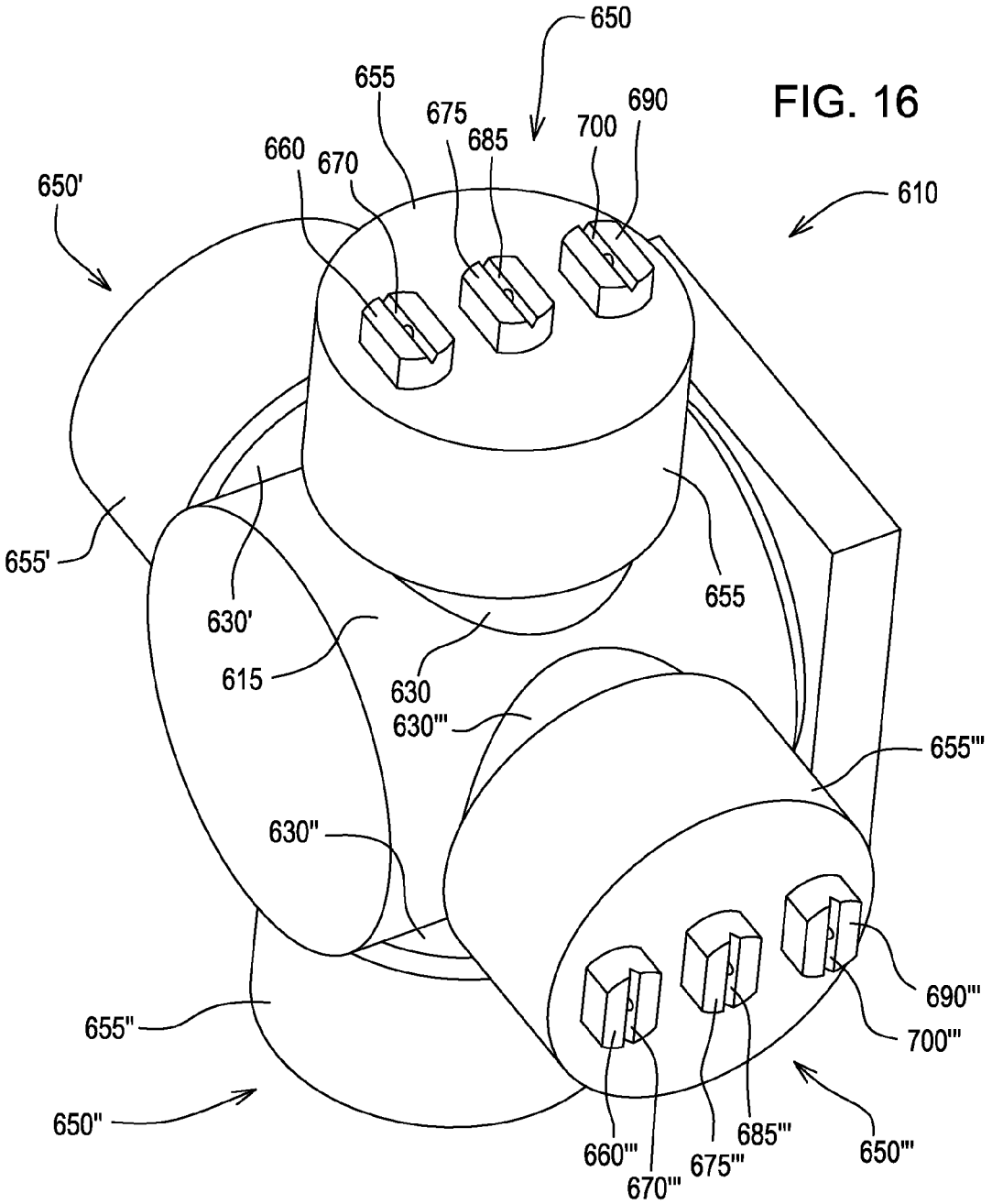
FIG. 16 is a perspective view of a sprayer nozzle apparatus including a plurality of sprayer nozzle cartridges according to yet another embodiment.

FIG. 16 illustrates a sprayer nozzle apparatus 610 of an agricultural sprayer (not shown) according to another embodiment. The sprayer nozzle apparatus 610 includes features similar to the sprayer nozzle apparatus 10 of FIGS. 1 and 2, and therefore, like components have been given like reference numerals plus 600 and only the differences between the sprayer nozzle apparatuses 10 and 610 will be discussed in detail below.

The sprayer nozzle apparatus 610 includes an adjustable apparatus housing 615 for supporting four nozzle connectors 630, 630', 630", 630'". More or less nozzle connectors 630, 630', 630", 630'" may be used. The nozzle connectors 630, 630', 630", 630'" support a plurality of sprayer nozzle cartridges 650, 650', 650", 650'", respectively. Exemplarily, the sprayer nozzle cartridges 650, 650', 650", 650'" include a cylindrically-shaped cartridge housing 655, 655', 655", 655'", respectively. A first nozzle tip 660, 660', 660", 660'", a second nozzle tip 675, 675', 675", 675'", and a third nozzle tip 690, 690', 690", 690'" are coupled to the cylindrically-shaped cartridge housing 655, 655', 655", 655'" in a linear pattern. This disclosure contemplates that the nozzle tips (660, 675, 690), (660', 675', 690'), (660", 675", 690"), (660'", 675'", 690'") may be coupled to the cylindrically-shaped cartridge housing 655, 655', 655", 655'" in any pattern (e.g., non-linear, circular, square). This disclosure also contemplates that the nozzle connector 630, 630', 630", 630'" and the cylindrically-shaped cartridge housing 655, 655', 655", 655'" may be any shape (e.g., square, rectangular, oblong).

Figure 17:
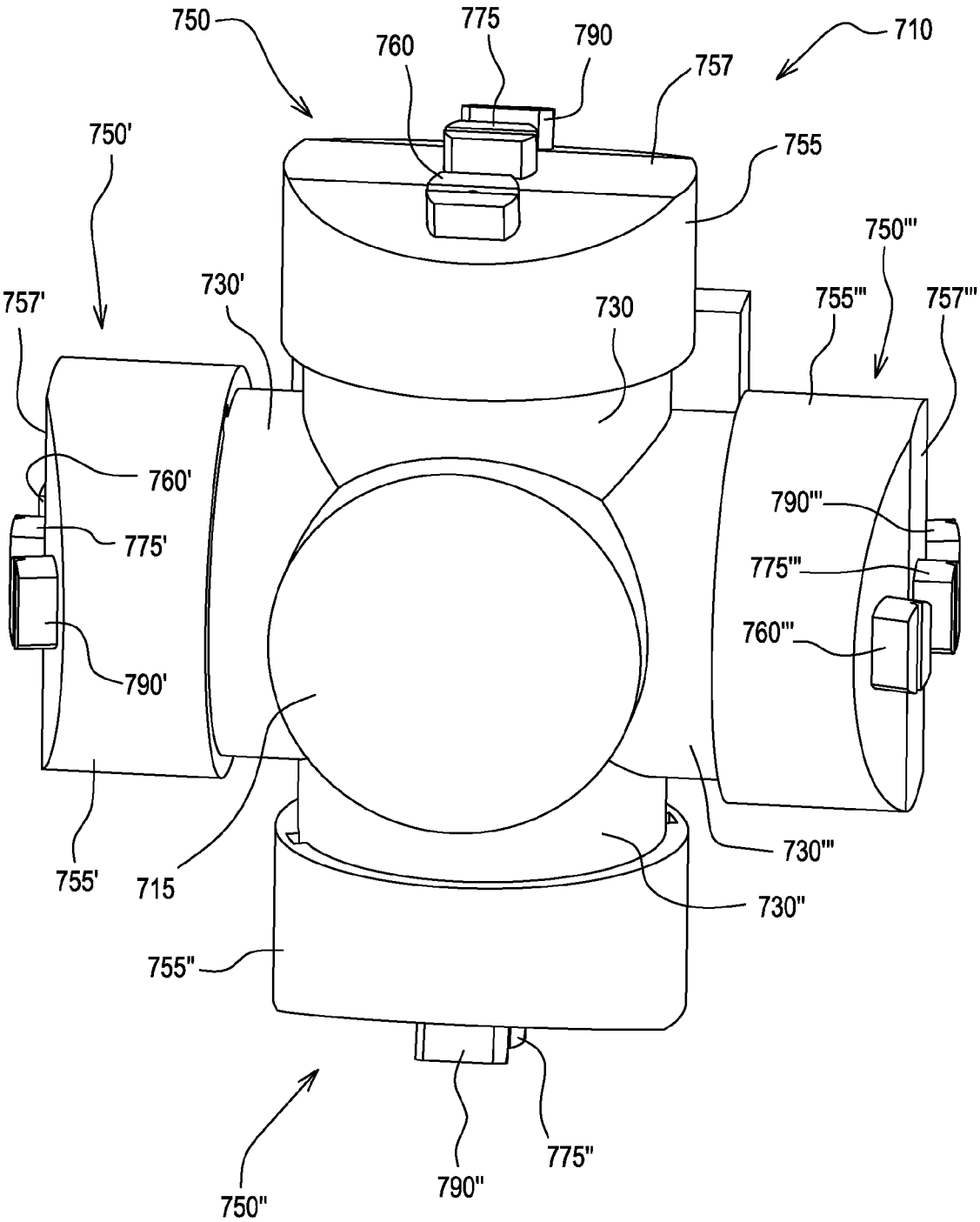
FIG. 17 is a perspective view of a sprayer nozzle apparatus including a plurality of sprayer nozzle cartridges according to another embodiment.
Figure 18:
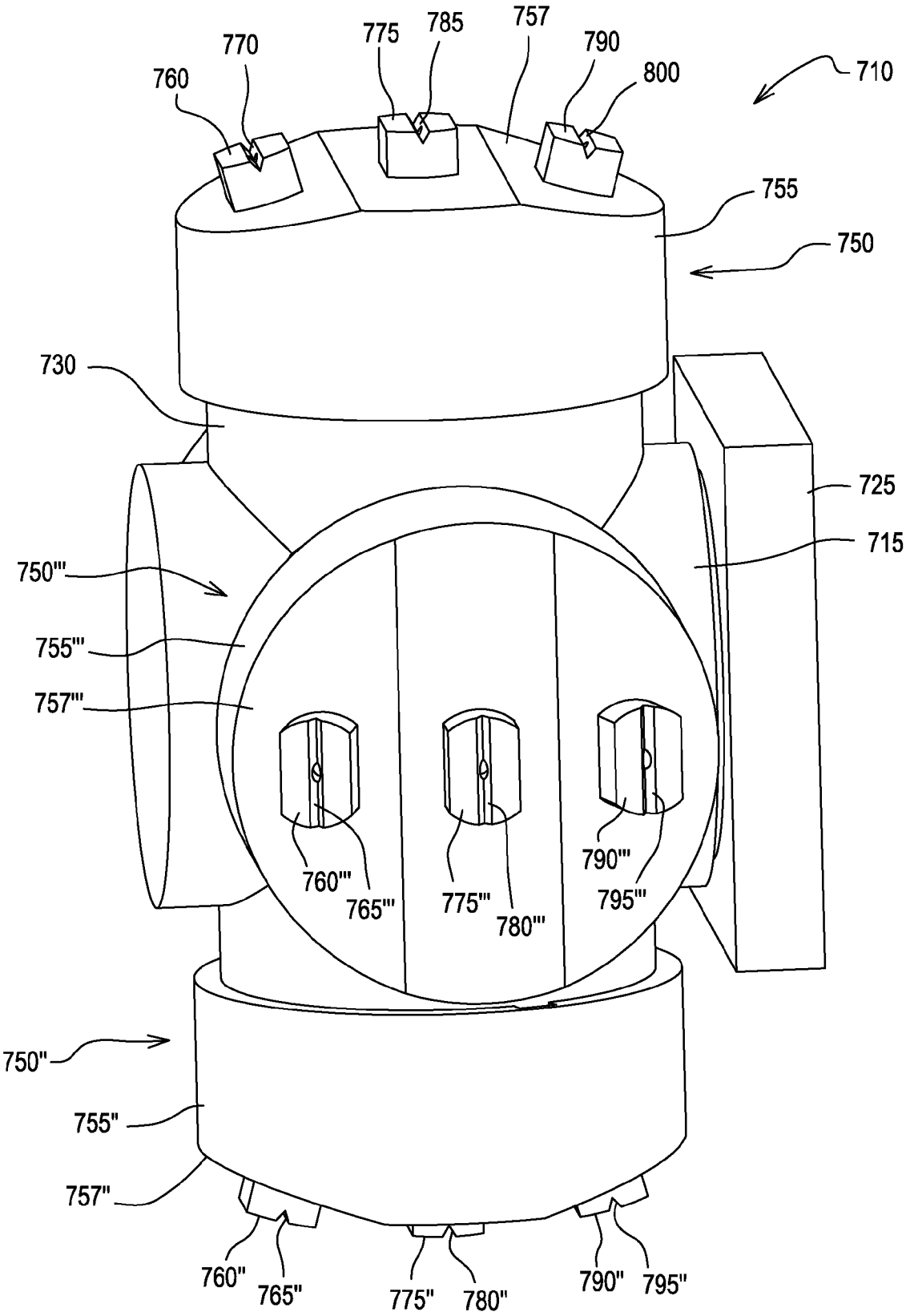
FIG. 18 is an enlarged right side view of the sprayer nozzle apparatus of FIG. 17.

FIGS. 17 and 18 illustrate a sprayer nozzle apparatus 710 of an agricultural sprayer (not shown) according to another embodiment. The sprayer nozzle apparatus 710 includes features similar to the sprayer nozzle apparatus 10 of FIGS. 1 and 2, and therefore, like components have been given like reference numerals plus 700 and only the differences between the sprayer nozzle apparatuses 10 and 710 will be discussed in detail below.

Referring to FIG. 18, the sprayer nozzle apparatus 710 includes an adjustable apparatus housing 715 having a fluid inlet 725 and supporting four nozzle connectors 730, 730', 730", 730'". More or less nozzle connectors 730, 730', 730", 730'" may be used. The nozzle connectors 730, 730', 730", 730'" support a plurality of sprayer nozzle cartridges 750, 750', 750", 750'". Exemplarily, the sprayer nozzle cartridges 750, 750', 750", 750'" include a cylindrically-shaped cartridge housing 755, 755', 755", 755'" having an overall convex surface 757, 757', 757", 757'". A first nozzle tip 760, 760', 760", 760'", a second nozzle tip 775, 775', 775", 775'", and a third nozzle tip 790, 790', 790", 790'" are coupled to the cylindrically-shaped cartridge housing 755, 755', 755", 755'" in a linear pattern. This disclosure contemplates that the nozzle tips (760, 775, 790), (760', 775', 790'), (760", 775", 790"), (760'", 775'", 790'") may be coupled to the cylindrically-shaped cartridge housing 755, 755', 755", 755'" in any pattern (e.g., non-linear, circular, square). This disclosure also contemplates that the nozzle connectors 730, 730', 730", 730'" and the cylindrically-shaped cartridge housing 755, 755', 755", 755'" may be any shape (e.g., square, rectangular, oblong).

Figure 19:
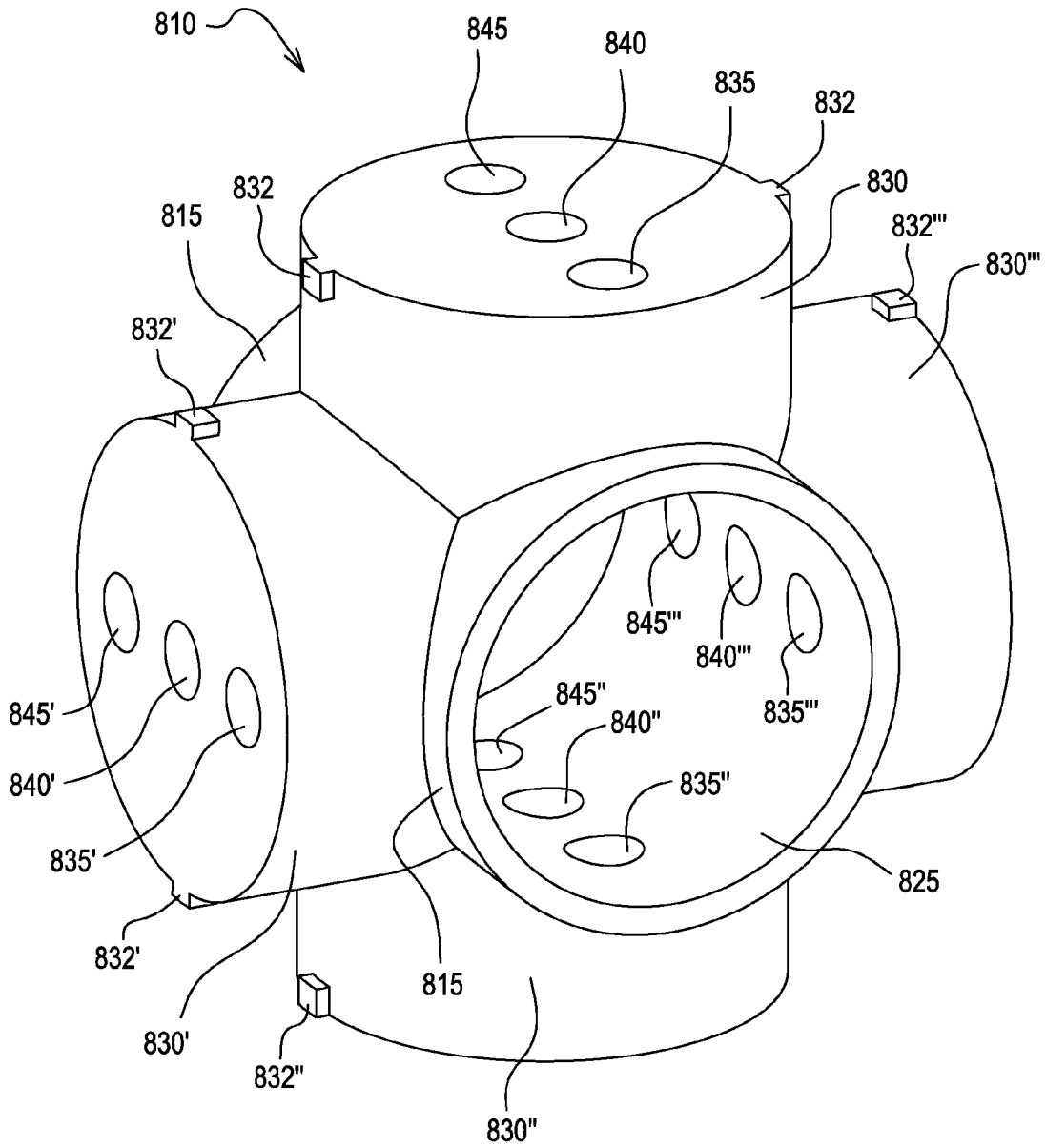
FIG. 19 is a perspective view of a portion of a sprayer nozzle apparatus according to yet another embodiment.
Figure 20:
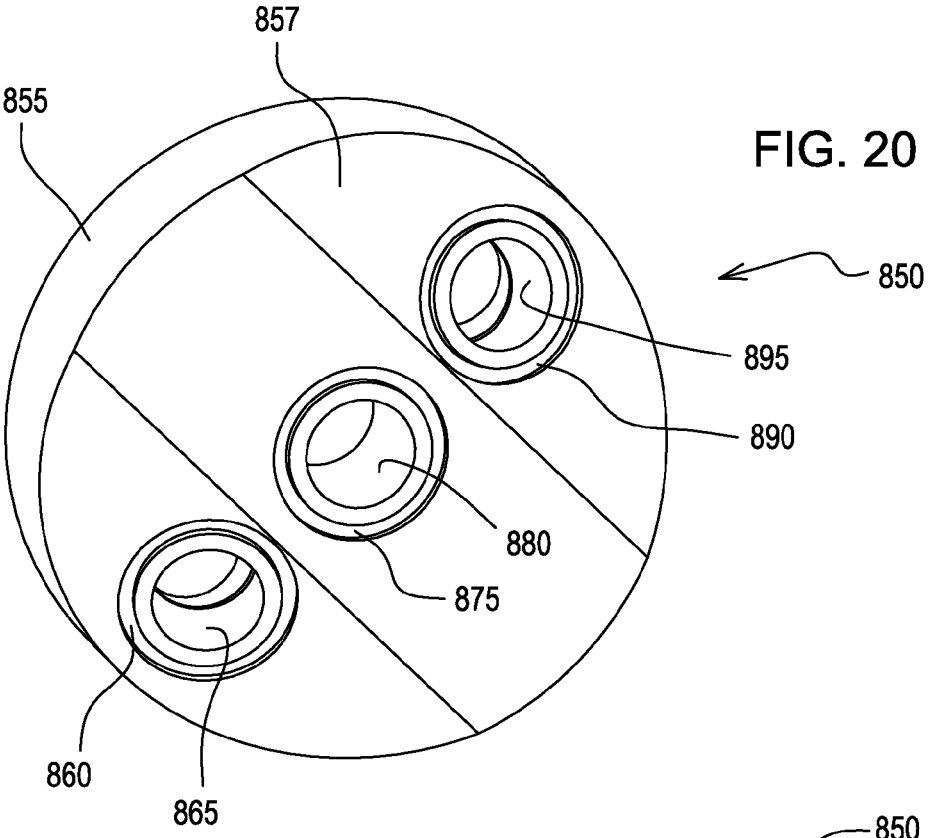
FIG. 20 is a perspective view of a sprayer nozzle cartridge according to another embodiment.
Figure 21:
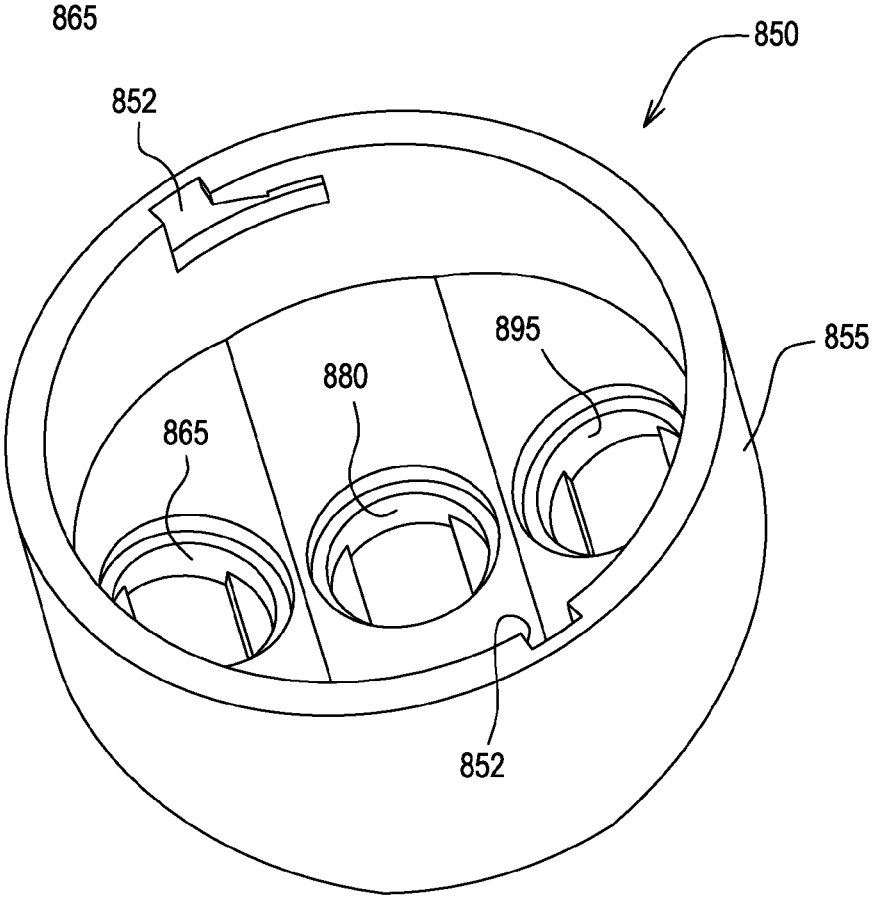
FIG. 21 is a perspective view of the sprayer nozzle cartridge of FIG. 20.

FIGS. 19-21 illustrate a sprayer nozzle apparatus 810 of an agricultural sprayer (not shown) according to another embodiment. The sprayer nozzle apparatus 810 includes features similar to the sprayer nozzle apparatus 10 of FIGS. 1 and 2, and therefore, like components have been given like reference numerals plus 800 and only the differences between the sprayer nozzle apparatuses 10 and 810 will be discussed in detail below.

With reference to FIG. 19, the sprayer nozzle apparatus 810 includes an adjustable apparatus housing 815 having a fluid inlet 825 and supporting four nozzle connectors 830, 830', 830", 830'". More or less nozzle connectors 830, 830', 830", 830'" may be used. The nozzle connectors 830, 830', 830", 830'" have protrusions 832, 832', 832", 832'" that are received by a sprayer nozzle cartridge 850 (FIG. 20). Referring to FIG. 21, the sprayer nozzle cartridge 850 includes slots 852 for releaseably engaging the protrusions 832.

With further reference to FIG. 20, exemplarily, the sprayer nozzle cartridges 850 include a cylindrically-shaped cartridge housing 855 having an overall convex surface 857. A first nozzle tip 860 having a first flow path 865, a second nozzle tip 875 having a second flow path 880, and a third nozzle tip 890 having a third flow path 895 are coupled to the cylindrically-shaped cartridge housing 855 in a linear pattern. This disclosure contemplates that the nozzle tips 860, 875, 890 may be coupled to the cylindrically-shaped cartridge housing 855 in any pattern (e.g., non-linear, circular, square). This disclosure also contemplates that the nozzle connectors 830, 830', 830", 830'" (FIG. 19) and the cylindrically-shaped cartridge housing 855 may be any shape (e.g., square, rectangular, oblong).

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

Various features are set forth in the following claims.

What is claimed is:

1. A sprayer nozzle apparatus adapted for receiving a fluid from a spray line of an agricultural sprayer, the sprayer nozzle apparatus comprising:

an apparatus housing;

a control element rotatably coupled to the apparatus housing;

a first nozzle connector comprising a first supply path and a second supply path, the first nozzle connector coupled to the apparatus housing; and a second nozzle connector comprising a third supply path and a fourth supply path, the second nozzle connector coupled to the apparatus housing;

wherein the control element is configured to receive fluid from the spray line and selectively communicate fluid to at least one of the first supply path and the second supply path in a first position and to at least one of the third supply path and the fourth supply path in a second position.

2. The sprayer nozzle apparatus of claim 1, wherein, the apparatus housing rotates automatically.

3. The sprayer nozzle apparatus of claim 1, wherein, the apparatus housing rotates remotely.

4. The sprayer nozzle apparatus of claim 1, wherein, in the first position, the control element selectively communicates fluid to both the first supply path and the second supply path.

5. The sprayer nozzle apparatus of claim 1, wherein, the control element is configured to change supply paths while the agricultural sprayer is moving.

6. The sprayer nozzle apparatus of claim 1, wherein, the first nozzle connector and the second nozzle connector are opposite each other on a surface of the apparatus housing.

7. The sprayer nozzle apparatus of claim 1, wherein, the first nozzle connector and the second nozzle connector and two other nozzle connectors uniformly encircle a surface of the apparatus housing.

8. The sprayer nozzle apparatus of claim 1, further comprising a first sprayer nozzle cartridge coupled to the first nozzle connector, the first sprayer nozzle cartridge comprising a first cartridge housing, a first nozzle tip comprising a first flow path in fluid communication with the first supply path, the first nozzle tip coupled to the first cartridge housing, and a second nozzle tip comprising a second flow path in fluid communication with the second supply path, the second nozzle tip coupled to the first cartridge housing.

9. The sprayer nozzle apparatus of claim 8, wherein the first nozzle tip and the second nozzle tip have varying geometries.

10. A sprayer nozzle apparatus adapted for receiving a fluid from a spray line of an agricultural sprayer, the sprayer nozzle apparatus comprising:

an apparatus housing;

a control element rotatably coupled to the apparatus housing;

a plurality of nozzle connectors comprising a plurality of supply paths, the plurality of nozzle connectors coupled to the apparatus housing;

wherein the control element is configured to receive fluid from the spray line and selectively communicate fluid to at least one of the plurality of supply paths of one of the plurality of nozzle connectors in a first position and to at least one of the plurality of supply paths of another of the plurality of nozzle connectors in a second position;

the plurality of nozzle connectors are each coupled to a sprayer nozzle cartridge; and each of the plurality of nozzle connectors couples to its corresponding sprayer nozzle cartridge by protrusions on the nozzle connectors and slots on the sprayer nozzle cartridges, wherein the slots releaseably engage the corresponding protrusions.

11. The sprayer nozzle apparatus of claim 10, wherein, in the first position, the control element selectively communicates fluid to more than one of the plurality of supply paths.

12. The sprayer nozzle apparatus of claim 10, wherein, the apparatus housing rotates under remote control.

13. The sprayer nozzle apparatus of claim 10, each sprayer nozzle cartridge comprises a cartridge housing, a plurality of nozzle tips comprising a plurality of flow paths in fluid communication with the plurality of supply paths, the plurality of nozzle tips coupled to the cartridge housing.

14. A sprayer nozzle apparatus adapted for receiving a fluid from a spray line of an agricultural sprayer, the sprayer nozzle apparatus comprising:

an apparatus housing;

a control element rotatably coupled to the apparatus housing;

a first nozzle connector comprising a first supply path and a second supply path, the first nozzle connector coupled to the apparatus housing;

a second nozzle connector comprising a third supply path and a fourth supply path, the second nozzle connector coupled to the apparatus housing;

a first sprayer nozzle cartridge coupled to the first nozzle connector, the first sprayer nozzle cartridge comprising a first cartridge housing, a first nozzle tip comprising a first flow path in fluid communication with the first supply path, the first nozzle tip coupled to the first cartridge housing, and a second nozzle tip comprising a second flow path in fluid communication with the second supply path, the second nozzle tip coupled to the first cartridge housing; and a second sprayer nozzle cartridge coupled to the second nozzle connector, the second sprayer nozzle cartridge comprising a second cartridge housing, a third nozzle tip comprising a third flow path in fluid communication with the third supply path, the third nozzle tip coupled to the second cartridge housing, and a fourth nozzle tip comprising a fourth flow path in fluid communication with the fourth supply path, the fourth nozzle tip coupled to the second cartridge housing;

wherein the control element is configured to receive fluid from the spray line and selectively communicate fluid to at least one of the first supply path and the second supply path in a first position and to at least one of the third supply path and the fourth supply path in a second position.

15. The sprayer nozzle apparatus of claim 14, wherein, the apparatus housing rotates automatically.

16. The sprayer nozzle apparatus of claim 14, wherein, the apparatus housing rotates remotely.

17. The sprayer nozzle apparatus of claim 14, wherein, in the first position, the control element selectively communicates fluid to both the first supply path and the second supply path.

18. The sprayer nozzle apparatus of claim 14, wherein, the control element changes supply paths while the agricultural sprayer is in motion.

19. The sprayer nozzle apparatus of claim 14, wherein, the first nozzle connector and the second nozzle connector are located 90 degrees away from each other on an outer surface of the apparatus housing.

20. The sprayer nozzle apparatus of claim 14, wherein, each nozzle connector couples to a corresponding sprayer nozzle cartridge by protrusions on the nozzle connector and slots on the sprayer nozzle cartridge, wherein the slots releaseably engage the corresponding protrusions.

* * * * *